US006172013B1

(12) United States Patent
Holt et al.

(10) Patent No.: US 6,172,013 B1
(45) **Date of Patent: *Jan. 9, 2001**

(54) LUBRICATING OIL COMPOSITION COMPRISING TRINUCLEAR MOLYBDENUM COMPOUND AND DIESTER

(75) Inventors: David G. L. Holt, Brights Grove (GB); Daniel P. Leta, Flemington, NJ (US)

(73) Assignee: Exxon Chemical Patents Inc, Linden, NJ (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/932,267

(22) Filed: Sep. 17, 1997

(51) Int. Cl.[7] ..... C10M 141/12

(52) U.S. Cl. ..... 508/364; 508/363; 508/370; 508/379; 508/443; 508/496; 508/499

(58) Field of Search ..... 508/363, 364, 508/379, 370, 443, 496, 499

(56) References Cited

U.S. PATENT DOCUMENTS

| | | | | |
|---|---|---|---|---|
| 4,376,711 | | 3/1983 | Shaub . | |
| 4,479,883 | | 10/1984 | Shaub et al. . | |
| 4,501,678 | | 2/1985 | Reierson et al. . | |
| 4,846,983 | * | 7/1989 | Ward, Jr. | 508/363 |
| 4,966,719 | | 10/1990 | Coyle et al. . | |
| 4,978,464 | | 12/1990 | Coyle et al. . | |
| 4,995,996 | | 2/1991 | Coyle et al. . | |
| 5,641,731 | * | 6/1997 | Baumgart et al. | 508/183 |
| 5,763,369 | * | 6/1998 | Baumgart et al. | 508/183 |
| 5,837,657 | * | 11/1998 | Fang et al. | 508/363 |
| 5,888,945 | * | 3/1999 | Stiefel et al. | 508/363 |
| 5,906,968 | * | 5/1999 | McConnachie et al. | 508/363 |
| 6,010,987 | * | 1/2000 | Stiefel et al. | 508/363 |

FOREIGN PATENT DOCUMENTS

| | | |
|---|---|---|
| WO 96/28525 | 9/1996 | (WO) . |
| WO 96/37581 | 11/1996 | (WO) . |

* cited by examiner

*Primary Examiner*—Jerry D. Johnson

(57) ABSTRACT

Lubricating oil compositions having enhanced friction coefficient and wear properties are provided by compositions of an oil of lubricating viscosity with additives of molybdenum and diesters of aliphatic or aromatic dicarboxylic acids.

5 Claims, No Drawings

LUBRICATING OIL COMPOSITION COMPRISING TRINUCLEAR MOLYBDENUM COMPOUND AND DIESTER

FIELD OF THE INVENTION

The invention relates to lubricating oil compositions having enhanced friction coefficients and improved wear properties. More particularly this invention relates to synergistically enhancing the friction coefficient and wear properties of lubricating compositions by molybdenum and particular ester additives.

BACKGROUND OF THE INVENTION

Lubricating compositions in use today are prepared from a wide variety of natural and synthetic base stocks to which have been mixed various additive packages and solvents depending upon the intended field of application. The various additives employed in the additives packages can include one or more additives selected from viscosity index improvers, corrosion inhibitors, oxidation inhibitors, dispersants, lube oil flow improvers, detergents and rust inhibitors, pour point depressants, anti-foaming agents, antiwear agents, seal swellants, friction modifiers, extreme pressure agents, color stabilizers, demulsifiers, wetting agents, water loss improving agents, bactericides, drill bit lubricants, thickeners or gellants, anti-emulsifying agents, metal deactivators, and additive solubilizers. These additives are added to base stocks such as mineral oils, highly refined mineral oils, poly alpha olefins, polyalkylene glycols, phosphate esters, silicone oils, diesters and polyol esters.

There has been considerable effort expended to develop lubricating oil compositions which will reduce friction and wear in engines, particularly automobile engines, since such reduced friction and wear improves the fuel efficiency of the engine. As a result of these efforts, various friction-modifiers and new reduction additives have been added to lubricating compositions.

A number of oil soluble molybdenum (Mo) compounds have been disclosed as useful in providing desirable lubricating oil properties such as antiwear, antioxidant and friction reduction properties. Among the disclosures of molybdenum compounds for such purposes there may be mentioned U.S. Pat. Nos. 4,164,473; 4,176,073; 4,176,074; 4,192,757; 4,248,720; 4,201,683; 4,289,635; 4,479,883 and Japanese Paten Publication No. 56000896. As an example of such molybdenum compounds, there may be mentioned, molybdenum dithiocarbamate (MoDTC) which has been recognized as providing benefits in all three of the aforesaid areas. Good antiwear and antioxidant benefits as well as some friction modification properties are obtained at molybdenum concentrations of 100 ppm. For good friction modification properties, molybdenum concentration of about 500 ppm are employed.

For improved lubricating oil package stability in engine oils, especially for fully synthetic oils, and also for improved sludge handling, piston cleanliness and antioxidant benefits, small amount of generally from about 5 to about 15 wt % of ester base oils have been employed.

It has previously been disclosed in U.S. Pat. No. 4,479,883 that lubricating oil compositions of somewhat improved friction reducing properties are obtained when a hydroxy substituted soluble ester of a saturated or unsaturated polycarboxylic acid having from 24 to 90 carbon atoms between the carboxylic acid groups and a metal dithiocarbamate such as a molybdenum dithiocarbamate (MoDTC) are both employed in a lubricating oil composition.

However, when an additive of a high hydroxyl ester comprising trimethylolpropane and a $C_8$–$C_{10}$ acid having about one hydroxyl group per molecule of trimethylolpropane left unconverted is employed as an ester in combination with a MoDTC and added to a lubricating oil composition the end friction coefficient and wear volume properties were not improved, but were found to be generally less favorable than a composition of the lubricating oil and the high hydroxyl ester of trimethylolpropane and a $C_8$–$C_{10}$ acid.

There continues to be a need for additives that can be added to lubricating base composition to provide significantly enhanced and improved properties in regard to friction coefficients and wear properties.

SUMMARY OF THE INVENTION

Lubricating compositions of significantly enhanced friction coefficient and wear properties are provided in accordance with this invention by providing a lubricating composition comprising a major amount of oil of lubricating viscosity and a minor amount of an additive comprising molybdenum and a dialkyl ester of an aliphatic or aromatic dicarboxylic acid. It has been discovered that the combination of molybdenum and the aforesaid dicarboxylic acid diesters produce an unexpected, significantly synergistically enhanced effect with respect to reduced engine friction and wear.

The molybdenum additive will generally comprise from about 0.005 wt % to about 0.2 wt %, preferably from about 0.01 to about 0.1 wt % and the diester additive will generally comprise from about 3 wt % to about 20 wt %, preferably from about 5 to about 12 wt % of the total lubricating oil composition.

DETAILED DESCRIPTION OF THE INVENTION

The lubricating compositions of this invention can comprise any suitable oil having a lubricating viscosity and can be used in formulations for various lubricants, such as, crankcase engine oils (i.e., passenger car motor oils, heavy duty diesel motor oils, and passenger car diesel oils), two-cycle engine oils, catapult oil, hydraulic fluids, drilling fluids, aircraft and other turbine oils, greases, compressor oils, functional fluids and other industrial and engine lubrication applications. The lubricating oils contemplated for use with the present invention include animal, vegetable, mineral or synthetic hydrocarbon oils of lubricating viscosity and mixtures thereof. The synthetic hydrocarbon oils include long chain alkanes such as cetanes and olefin polymers such as oligomers of hexene, octene, decene, and dodecene, etc. The other synthetic oils include (1) fully esterified ester oils, with no free hydroxyls, such as pentaerythritol esters of monocarboxylic acids having 2 to 20 carbon atoms, trimethylol propane esters of monocarboxylic acids having 2 to 20 carbon atoms, (2) polyacetals and (3) siloxane fluids. Especially useful among the synthetic esters are those made from polycarboxylic acids and monohydric alcohols. More preferred are the ester fluids made by fully esterifying pentaerythritol, or mixtures thereof with di- and tripentaerythritol, with an aliphatic monocarboxylic acid containing from 1 to 20 carbon atoms, or mixtures of such acids.

The oils of lubricating viscosity suitable for use in the composition of this invention are natural oils, hydrocarbon-based oils and synthetic oils, preferably the natural oils being at least one oil selected from rapeseed oils, canola oils and sunflower oils; said hydrocarbon-based oils are at least one oil selected from mineral oils and highly refined mineral oils; and said synthetic oils are at least one oil selected from poly alpha olefine, polyalkylene glycols, polyisobutylenes, phosphate esters, silicone oils, polyol esters, and other synthetic esters.

In some of the lubricant formulations set forth above a solvent be employed depending upon the specific application. Solvents that can be used include the hydrocarbon solvents, such as toluene, benzene, xylene, and the like.

Crankcase Lubricating Oils

The compositions can be used in the formulation of crankcase lubricating oils (i.e., passenger car motor oils, heavy duty diesel motor oils, and passenger car diesel oils) for spark-ignited and compression-ignited engines. The additives listed below are typically used in such amounts so as to provide their normal attendant functions. Typical amounts for individual components are also set forth below. All the values listed are stated as mass percent active ingredient.

| ADDITIVE | MASS % (Broad) | MASS % (Preferred) |
|---|---|---|
| Ashless Dispersant | 0.1–20 | 1–8 |
| Metal detergents | 0.1–15 | 0.2–9 |
| Corrosion Inhibitor | 0–5 | 0–1.5 |
| Metal dihydrocarbyl dithiophosphate | 0.1–6 | 0.1–4 |
| Supplemental anti-oxidant | 0–5 | 0.01–1.5 |
| Pour Point Depressant | 0.01–5 | 0.01–1.5 |
| Anti-Foaming Agent | 0–5 | 0.001–0.15 |
| Supplemental Anti-wear Agents | 0–0.5 | 0–0.2 |
| Friction Modifier | 0–5 | 0–1.5 |
| Viscosity Modifier | 0.01–6 | 0–4 |
| Synthetic and/or Mineral Base Stock | Balance | Balance |

The individual additives may be incorporated into a base stock in any convenient way. Thus, each of the components can be added directly to the base stock by dispersing or dissolving it in the base stock at the desired level of concentration. Such blending may occur at ambient temperature or at an elevated temperature.

Preferably, all the additives except for the viscosity modifier and the pour point depressant are blended into a concentrate or additive package described herein as the additive package, that is subsequently blended into base stock to make finished lubricant. Use of such concentrates is conventional. The concentrate will typically be formulated to contain the additive(s) in proper amounts to provide the desired concentration in the final formulation when the concentrate is combined with a predetermined amount of base lubricant.

The concentrate is preferably made in accordance with the method described in U.S. Pat. No. 4,938,880. That patent describes making a pre-mix of ashless dispersant and metal detergents that is pre-blended at a temperature of at least about 100° C. Thereafter, the pre-mix is cooled to at least 85° C. and the additional components are added.

The final crankcase lubricating oil formulation may employ from 2 to 20 mass % and preferably 5 to 10 mass %, typically about 7 to 8 mass % of the concentrate or additive package with the remainder being base stock.

The ashless dispersant comprises an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. The ashless dispersant may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine.

The viscosity modifier (VM) functions to impart high and low temperature operability to a lubricating oil. The VM used may have that sole function, or may be multifunctional.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isporene/butadiene, as well as the partially hydrogenated homopolymers of butadiene and isoprene and isoprene/divinylbenzene.

Metal-containing or ash-forming detergents function both as detergents to reduce or remove deposits and as acid neutralizers or rust inhibitors, thereby reducing wear and corrosion and extending engine life. Detergents generally comprise a polar head with long hydrophobic tail, with the polar head comprising a metal salt of an acid organic compound. The salts may contain a substantially stoichiometric amount of the metal in which they are usually described as normal or neutral salts, and would typically have a total base number (TBN), as may be measured by ASTM D-2896 of from 0 to 80. It is possible to include large amounts of a metal base by reacting an excess of a metal compound such as an oxide or hydroxide with an acid gas such a such as carbon dioxide. The resulting overbased detergent comprises neutralized detergent as the outer layer of a metal base (e.g., carbonate) micelle. Such overbased detergents may have a TBN of 150 or greater, and typically from 250 to 450 or more.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased calcium sulfonates having TBN of from 20 to 450 TBN, and neutral and overbased calcium phenates and sulfurized phenates having TBN of from 50 to 450.

Dihydrocarbyl dithiophosphate metal salts are frequently used as secondary anti-wear and antioxidant agents. The zinc salts are most commonly used in lubricating oil in amounts of 0.1 to 10, preferably 0.2 to 2 wt. %, based upon the total weight of the lubricating oil composition.

Oxidation inhibitors or antioxidants reduce the tendency of base stocks to deteriorate in service which deterioration can be evidenced by the products of oxidation such as sludge and varnish-like deposits on the metal surfaces and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, ashless oil soluble phenates and sulfurized phenates, phosphosulfurized or sulfurized hydrocarbons, phosphorous esters, metal thiocarbamates and oil soluble copper compounds as described in U.S. Pat. No. 4,867,890.

Secondary friction modifiers may be included to improve fuel economy. Oil-soluble alkoxylated mono- and di-amines are well known to improve boundary layer lubrication. The amines may be used as such or in the form of an adduct or reaction product with a boron compound such as a boric oxide, boron halide, metaborate, boric acid or a mono-, di or tri-alkyl borate.

Other friction modifiers are known. Among these are esters formed by reacting carboxylic acids and anhydrides with alkanols. Other conventional friction modifiers generally consist of a polar terminal group (e.g. carboxyl or hydroxyl) covalently bonded to an oleophillic hydrocarbon chain. Esters of carboxylic acids and anhydrides with alkanols are described in U.S. Pat. No. 4,702,850. Examples of other conventional friction modifiers are described by M. Belzer in the "Journal of Tribology" (1992), Vol. 114, pp. 675–682 and M. Belzer and S. Jahanmir in "Lubrication Science" (1988), Vol. 1, pp. 3–26. One such example is organo-metallic molybdenum.

Rust inhibitors selected from the group consisting of nonionic polyoxyalkylene polyols and esters thereof, polyoxyalkylene phenols, and anionic alkyl sulfonic acids may be used.

Copper and lead bearing corrosion inhibitors may be used, but are typically not required with the formulation of the present invention. Typically such compounds are the thiadiazole polysulfides containing from 5 to 50 carbon atoms, their derivatives and polymers thereof. Derivatives of 1,3,4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in UK. Patent Specification No. 1,560,830. Benzotriazoles derivatives also fall within this class of additives. When these compounds are included in the lubricating composition, they are preferably present in an amount not exceeding 0.2 wt % active ingredient.

A small amount of a demulsifying component may be used. A preferred demulsifying component is described in EP 330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.005 mass % active ingredient is convenient.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers, polyalkylmethacrylates and the like.

Foam control can be provided by many compounds including an antifoamant of the polysiloxane type, for example, silicone oil or polydimethyl siloxyane.

Some of the above-mentioned additives can provide a multiplicity of effects; thus for example, a single additive may act as a dispersant-oxidation inhibitor. This approach is well known and does not require further elaboration.

Two-Cycle Engine Oils

The compositions can be used in the formulation of two-cycle engine oils together with selected lubricant additives. The preferred two-cycle engine oil is typically formulated with any conventional two-cycle engine oil additive package. The additives listed below are typically used in such amounts so as to provide their normal attendant functions. The additive package may include, but is not limited to, viscosity index improvers, corrosion inhibitors, oxidation inhibitors, coupling agents, dispersants, extreme pressure agents, color stabilizers, surfactants, diluents, detergents and rust inhibitors, pour point depressants, antifoaming agents, and anti-wear agents.

The two-cycle engine oil according to the present invention can employ typically about 75 to 85% base stock, about 1 to 5% solvent, with the remainder comprising an additive package.

Examples of the above additives for use in lubricants are set forth in the following documents which are incorporated herein by reference: U.S. Pat. No. 4,663,063 (Davis), which issued on May 5, 1987; U.S. Pat. No. 5,330,667 (Tiffany, III et al.), which issued on Jul. 19, 1994; U.S. Pat. No. 4,740,321 (Davis et al.), which issued on Apr. 26, 1988; U.S. Pat. No. 5,321,172 (Alexander et al.), which issued on Jun. 14, 1994; and U.S. Pat. No. 5,049,291 (Miyaji et al.), which issued on Sep. 17, 1991.

Catapult Oils

Catapults are instruments used on aircraft carriers at sea to eject the aircraft off of the carrier. The compositions can be used in the formulation of catapult oils together with selected lubricant additives. The preferred catapult oil is typically formulated with any conventional catapult oil additive package. The additives listed below are typically used in such amounts so as to provide their normal attendant functions. The additive package may include, but is not limited to, viscosity index improvers, corrosion inhibitors, oxidation inhibitors, extreme pressure agents, color stabilizer, detergents and rust inhibitors, antifoaming agents, anti-wear agents, and friction modifiers. These additives are disclosed in Klamann, "Lubricants and Related Products", *Verlag Chemie,* Deerfield Beach, Fla., 1984, which is incorporated herein by reference.

The catapult oil according to the present invention can employ typically about 90 to 99% base stock, with the remainder comprising an additive package.

Hydraulic Fluids

The compositions can be used in the formulation of hydraulic fluids together with selected lubricant additives. The preferred hydraulic fluids are typically formulated with any conventional hydraulic fluid additive package. The additives listed below are typically used in such amounts so as to provide their normal attendant functions. The additive package may include, but is not limited to, viscosity index improvers, corrosion inhibitors, boundary lubrication agents, demulsifiers, pour point depressants, and antifoaming agents.

The hydraulic fluid according to the present invention can employ typically about 90 to 99% base stock, with the remainder comprising an additive package.

Other additives are disclosed in U.S. Pat. No. 4,783,274 (Jokinen et al.), which issued on Nov. 8, 1988, and which is incorporated herein by reference.

Drilling Fluids

The compositions can be used in the formulation of drilling fluids together with selected lubricant additives. The preferred drilling fluids are typically formulated with any conventional drilling fluid additive package. The additives listed below are typically used in such amounts so as to provide their normal attendant functions. The additive package may include, but is not limited to, viscosity index improvers, corrosion inhibitors, wetting agents, water loss improving agents, bactericides, and drill bit lubricants.

The drilling fluid according to the present invention can employ typically about 60 to 90% base stock and about 5 to 25% solvent, with the remainder comprising an additive package. See U.S. Pat. No. 4,382,002 (Walker et al), which issued on May 3, 1983, and which is incorporated herein by reference.

Suitable hydrocarbon solvents include: mineral oils, particularly those paraffin base oils of good oxidation stability with a boiling range of from 200–400° C. such as Mentor 28°, sold by Exxon Chemical Americas, Houston, Tex.; diesel and gas oils; and heavy aromatic naphtha.

Turbine Oils

The compositions can be used in the formulation of turbine oils together with selected lubricant additives. The preferred turbine oil is typically formulated with any conventional turbine oil additive package. The additives listed below are typically used in such amounts so as to provide their normal attendant functions. The additive package may include, but is not limited to, viscosity index improvers, corrosion inhibitors, oxidation inhibitors, thickeners, dispersants, anti-emulsifying agents, color stabilizer, detergents and rust inhibitors, and pour point depressants.

The turbine oil according to the present invention can employ typically about 65 to 75% base stock and about 5 to 30% solvent, with the remainder comprising an additive package, typically in the range between about 0.01 to about 5.0 weight percent each, based on the total weight of the composition.

Greases

The compositions can be used in the formulation of greases together with selected lubricant additives. The main ingredient found in greases is the thickening agent or gellant and differences in grease formulations have often involved this ingredient. Besides, the thickener or gellants, other properties and characteristics of greases can be influenced by the particular lubricating base stock and the various additives that can be used.

The preferred greases are typically formulated with any conventional grease additive package. The additives listed below are typically used in such amounts so as to provide their normal attendant functions. The additive package may include, but is not limited to, viscosity index improvers, oxidation inhibitors, extreme pressure agents, detergents and rust inhibitors, pour point depressants, metal deactivators, anti-wear agents, and thickeners or gellants.

The grease according to the present invention can employ typically about 80 to 95% base stock and about 5 to 20% thickening agent or gellant, with the remainder comprising an additive package.

Typical thickening agents used in grease formulations include the alkali metal soaps, clays, polymers, asbestos, carbon black, silica gels, polyureas and aluminum complexes. Soap thickened greases are the most popular with lithium and calcium soaps being most common. Simple soap greases are formed from the alkali metal salts of long chain fatty acids with lithium 12-hydroxystearate, the predominant one formed from 12-hydroxystearic acid, lithium hydroxide monohydrate and mineral oil. Complex soap greases are also in common use and comprise metal salts of a mixture of organic acids. One typical complex soap grease found in use today is a complex lithium soap grease prepared from 12-hydroxystearic acid, lithium hydroxide monohydrate, azelaic acid and mineral oil. The lithium soaps are described and exemplified in may patents including U.S. Pat. No. 3,758,407 (Harting), which issued on Sep. 11, 1973; U.S. Pat. No. 3,791,973 (Gilani), which issued on Feb. 12, 1974; and U.S. Pat. No. 3,929,651 (Murray), which issued on Dec. 30, 1975, all of which are incorporated herein by reference together with U.S. Pat. No. 4,392,967 (Alexander), which issued on Jul. 12, 1983.

A description of the additives used in greases may be found in Boner, "Modern Lubricating Greases", 1976, Chapter 5, which is incorporated herein by reference, as well as additives listed above in the other products.

Compressor Oils

The compositions can be used in the formulation of compressor oils together with selected lubricant additives. The preferred compressor oil is typically formulated with any conventional compressor oil additive package. The additives listed below are typically used in such amounts so as to provide their normal attendant functions. The additive package may include, but is not limited to, oxidation inhibitors, additive solubilizers, rust inhibitors/metal passivators, demulsifying agents, and anti-wear agents.

The compressor oil according to the present invention can employ typically about 80 to 99% base stock and about 1 to 15% solvent, with the remainder comprising an additive package.

The additives for compressor oils are also set forth in U.S. Pat. No. 5,156,759 (Culpon, Jr.), which issued on Oct. 20, 1992, and which is incorporated herein by reference.

For the lubricating oil compositions of this invention, any suitable soluble organo-molybdenum compound having friction modification and anti-wear properties may be employed. As example of such soluble organo-molybdenum compounds, there may be mentioned the dithiocarbamates, dithiophosphates, dithiophosphinates, xanthates, thioxanthates, sulfides, and the like, and mixtures thereof. Particularly preferred are molybdenum dialkyldithiocarbamates, thiocarbamates, dialkylthiophosphates, alkyl xanthates and alkylthioxanthates.

Among the molybdenum compounds useful in the compositions of this invention are organo-molybdenum compounds of the formula $$Mo(ROCS_2)_4$$

and $$Mo(RSCS_2)_4$$

wherein R is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are the dialkyldithiocarbamates of molybdenum.

Another group of organo-molybdenum compounds useful in the lubricating compositions of this invention are trinuclear molybdenum compounds, especially those of the formula $Mo_3S_kL_nQ_z$ and mixtures thereof wherein the L are independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

The ligands are independently selected from the group of

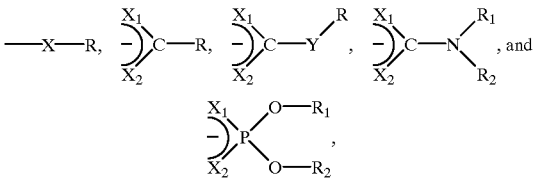

and mixtures thereof, wherein X, $X_1$, $X_2$, and Y are independently selected from the group of oxygen and sulfur, and wherein $R_1$, $R_2$, and R are independently selected from hydrogen and organo groups that may be the same or different. Preferably the organo groups are hydrocarbyl groups such as alkyl (e.g., in which the carbon atom attached to the remainder of the ligand is primary or secondary), aryl, substituted aryl and ether groups. More preferably, each ligand has the same hydrocarbyl group.

The term "hydrocarbyl" denotes a substituent having carbon atoms directly attached to the remainder of the ligand and is predominantly hydrocarbyl in character within the context of this invention. Such substituents include the following:

1. Hydrocarbon substituents, that is, aliphatic (for example alkyl or alkenyl), alicyclic (for example cycloalkyl or cycloalkenyl) substituents, aromatic-, aliphatic- and alicyclic-substituted aromatic nuclei and the like, as well as cyclic substituents wherein the ring is completed through another portion of the ligand (that is, any two indicated substituents may together form an alicyclic group).
2. Substituted hydrocarbon substituents, that is, those containing non-hydrocarbon groups which, in the context of this invention, do not alter the predominantly hydrocarbyl character of the substituent. Those skilled in the art will be aware of suitable groups (e.g., halo, especially chloro and fluoro, amino, alkoxyl, mercapto, alkylmercapto, nitro, nitroso, sulfoxy, etc.).
3. Hetero substituents, that is, substituents which, while predominantly hydrocarbon in character within the context of this invention, contain atoms other than carbon present in a chain or ring otherwise composed of carbon atoms.

Importantly, the organo groups of the ligands have a sufficient number of carbon atoms to render the compound soluble or dispersible in the oil. For example, the number of carbon atoms in each group will generally range between about 1 to about 100, preferably from about 1 to about 30, and more preferably between about 4 to about 20. Preferred ligands include dialkyldithiophosphate, alkylxanthate, and dialkyldithiocarbamate, and of these dialkyldithiocarbamate is more preferred. Organic ligands containing two or more of the above functionalities are also capable of serving as ligands and binding to one or more of the cores. Those skilled in the art will realize that formation of the compounds of the present invention requires selection of ligands having the appropriate charge to balance the core's charge.

Compounds having the formula $Mo_3S_kL_nQ_z$ to have cationic cores surrounded by anionic ligands and are represented by structures such as

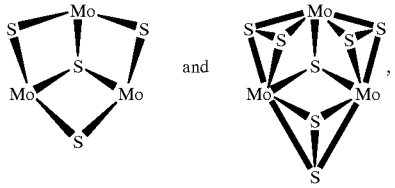

and have net charges of +4. Consequently, in order to solubilize these cores the total charge among all the ligands must be −4. Four monoanionic ligands are preferred. Without wishing to be bound by any theory, it is believed that two or more trinuclear cores may be bound or interconnected by means of one or more ligands and the ligands may be multidentate. Such structures fall within the scope of this invention. This includes the case of a multidentate ligand having multiple connections to a single core. It is believed that oxygen and/or selenium may be substituted for sulfur in the core(s).

Oil-soluble or dispersible trinulclear molybdenum compounds can be prepared by reacting in the appropriate liquid(s)/solvent(s) a molybdenum source such as $(NH_4)_2Mo_3S_{13}.n(H_2O)$, where n varies between 0 and 2 and includes non-stoichiometric values, with a suitable ligand source such as a tetralkylthiuram disulfide. Other oil-soluble or dispersible trinuclear molybdenum compounds can be formed during a reaction in the appropriate solvent(s) of a molybdenum source such as of $(NH_4)_2Mo_3S_{13}.n(H_2O)$, a ligand source such as tetralkylthiuram disulfide, dialkyldithiocarbamate, or dialkyldithiophosphate, and a sulfur abstracting agent such cyanide ions, sulfite ions, or substituted phosphines. Alternatively, a trinuclear molybdenum-sulfur halide salt such as $[M']_2[Mo_3S_7A_6]$, where M' is a counter ion, and A is a halogen such as Cl, Br, or I, may be reacted with a ligand source such as a dialkyldithiocarbamate or dialkyldithiophosphate in the appropriate liquid(s)/solvent(s) to form an oil-soluble or dispersible trinuclear molybdenum compound. The appropriate liquid/solvent may be for example aqueous or organic.

A compound's oil solubility or dispersibility may be influenced by the number of carbon atoms in the ligands' organo groups. In the compounds of the present invention, at least 21 total carbon atoms should be present among all the ligands' organo groups. Preferably, the ligand source chosen has a sufficient number of carbon atoms in its organo groups to render the compound soluble or dispersible in the lubricating composition.

The terms "oil-soluble" or "dispersible" used herein do not necessarily indicate that the compounds or additives are soluble, dissolvable, miscible, or capable of being suspended in the oil in all proportions. These do mean, however, that they are, for instance, soluble or stably dispersible in oil to an extend sufficient to exert their intended effect in the environment in which the oil is employed. Moreover, the additional incorporation of other additives may also permit incorporation of higher levels of a particular additive, if desired.

The lubricating compositions of the present invention may contain a minor effective amount, preferably about 1 ppm to 2,000 ppm molybdenum, more preferably from 5 to 750 ppm, and most preferably from 10 to 300 ppm, all based on the weight of the lubricating composition.

Any suitable diesters of aliphatic or aromatic dicarboxylic acids, preferably those having from about 6 to about 13 carbon atoms in the dicarboxylic acid and from about 6 to about 13 carbon atoms in such ester chain may be employed as the diesters of this invention. The diesters are diesters of the acids with two moles of linear or branched chain alcohols per mole of diacid.

As examples of suitable dicarboxylic acids employed to form the diesters, there may be mentioned aliphatic dicarboxylic acids such as adipic, pimelic, suberic, azelaic and 1,10-decane dicarboxylic acid, and the like and mixtures thereof, and aromatic dicarboxylic acids or suitable anhydrides thereof such as o-phthalic acid or anhydride, teraphthalic acid, biphenyl-2,2'-dicarboxylic acid and the like and mixtures thereof.

As examples of suitable alcohol employed to form the diesters, there may be mentioned aliphatic alcohols such as hexanol, heptanol, methyl hexanol, octanol, dimethyl hexanol, ethyl hexanol, methyl heptanol, nonanol, methyl octanol, decyl alcohol, dodecyl alcohol, tetradecanol, pentadecanol and the like and mixtures thereof.

A preferred alcohol is a mixture of 3–5 mole % n-$C_6$ alcohol, 48–58 mole % n-$C_8$ alcohol, 36–42 mole % n-$C_{10}$ alcohol and 0.5–1.0 mole % n-$C_{12}$ alcohol.

A preferred acid is a mixture of 3–5 mole % n-$C_6$ acid, 48–58 mole % n-$C_8$ acid, 36–42 mole % n-$C_{10}$ acid and 0.5–1.0 mole % n-$C_{12}$ acid.

Another class of useful monohydric alcohols is oxo alcohols. Oxo alcohols are manufactured via a process, whereby propylene and other olefins are oligomerized over a catalyst (e.g. a phosphoric acid on Kieselguhr clay) and then distilled to achieve various unsaturated (olefinic) streams largely comprising a single carbon number. These streams are then reacted under hydroformylation conditions using a cobalt carbonyl catalyst with synthesis gas (carbon monoxide and hydrogen) so as to produce a multi-isomer mix of aldehydes/alcohols. The mix of aldehydes/alcohols is then introduced to a hydrogenation reactor and hydrogenated to a mixture of branched alcohols comprising mostly alcohols of one carbon greater than the number of carbons in the feed olefin stream.

The branched oxo alcohols are preferably monohydric oxo alcohols which have a carbon number in the range between about $C_6$ to $C_{13}$. The most preferred monohydric oxo alcohols according to the present invention include iso-octyl alcohol, e.g. Exxal™ 8 alcohol, formed from the cobalt oxo process and 2-ethylhexanol which is formed form the rhodium oxo process.

the term "iso" is meant to convey a multiple isomer product made by the oxo process. It is desirable to have a branched oxo alcohol comprising multiple isomers, preferably more than 3 isomers, most preferably more than 5 isomers.

Branched oxo alcohols may be produced in the so-called "oxo" process by hydrofromylation of commercial branched $C_5$ to $C_{12}$ olefin fractions to a corresponding branched $C_6$ to $C_{13}$ alcohol/aldehyde-containing oxonation products. In the process for forming oxo alcohols, it is desirable to form an alcohol/aldehyde intermediate from the oxonation product followed by conversion of the crude oxo alcohol/aldehyde product to an all oxo alcohol product.

The production of branched oxo alcohols from the cobalt catalyzed hydroformylation of an olefinic feedstream preferably comprises the following steps:

a) hydrofromylating an olefinic feedstream by reaction with carbon monoxide and hydrogen (i.e. synthesis gas) in the presence of a hydroformylation catalyst under reaction conditions that promote the formation of an alcohol/aldehyde-rich crude reaction product;

b) demetalling the alcohol/aldehyde-rich crude reaction product to recover therefrom the hydroformylation catalyst and a substantially catalyst-free, alcohol/aldehyde-rich crude reaction product; and c) hydrogenating the alcohol/aldehyde-rich crude reaction product in the presence of a hydrogenation catalyst (e.g. massive nickel catalyst to produce an alcohol-rich reaction product.

The olefinic feedstream is preferably any $C_5$ to $C_{12}$ olefin, more preferably branched $C_7$ to $C_9$ olefins. Moreover, the olefinic feedstream if preferably a branched olfein, although a linear olefin which is capable of producing all branched oxo alcohols is also contemplated herein. The hydroformylation and subsequent hydrogenation in the presence of an alcohol-forming catalyst, is capable of producing branched $C_5$ to $C_{13}$ alcohols, more preferably branched $C_8$ alcohol (i.e. Exxal™ 8), branched $C_9$ alcohol (i.e. Exxal™ 9), and isodecyl alcohol. Each of the branched oxo $C_5$ to $C_{13}$ alcohols formed by the oxo process typically comprises, for example, a mixture of branched oxo alcohol isomers, e.g. Exxal™ 8 alcohol comprises a mixture of 3,5-dimethyl hexanol, 4,5-dimethyl hexanol, 3,4-dimethyl hexanol, 5-methyl heptanol, 4-methyl heptanol and a mixture of other methyl heptanols and dimethyl hexanols.

Any type of catalyst known to one of ordinary skill in the art which is capable of converting oxo aldehydes to oxo alcohols is contemplated by the present invention.

The diesters of the dicarboxylic acids will generally be employed in the lubricating compositions in an amount of from about 5.0 wt % to about 15 wt %, preferably from about 7 wt % to about 12 wt %.

The invention will be more fully understood by the following examples illustrating various modifications of the invention which should not be construed as limiting the scope thereof.

EXAMPLES

A formulated 5W-40 lubricating oil using PAO as its basestock, a poly alpha olefin base oil of 1-decane oligomer with a standard additive package, was employed as the lubricating composition in the Examples. To this lubricating composition was added either molybdenum alone, a diester alone or a combination of molybdenum and a diester. The molybdenum employed was molybdenum dithiocarbamate (MoDTC) and the diester as indicated. The resulting compositions were than evaluated for engine friction coefficients and wear volume in a Falex Block-on-Ring tribometer at 100° C. with a 220 lb. (99.8 kg) load, a speed of 420 rpm (0.77 m/s), and a two hour test length. Friction coefficients are reported as end of run value. The end of run values shows relative standard deviations (1 σ) of approximately 1.5%. Following the testing, wear volumes are determined by multiple scan profilometry. For a SuperFlow QC sample the relative standard deviation (1 σ) is approximately 12%.

| Composition | Friction Coefficient | Wear Volume $10^2$ $mm^3$ |
|---|---|---|
| 1 PAO base oil | 0.119 | 2.68 |
| 2 PAO + 10 wt % di-isotridecyl adipate | 0.120 | 2.17 |
| 3 PAO + 10 wt % di-isodecyl azelate | 0.116 | 1.93 |
| 4 PAO + 10 wt % di-isotridecyl dodecandioate | 0.116 | 2.5 |
| 5 PAO + 0.2 wt % MoDTC * | 0.085 | 2.2 |

-continued

| Composition | Friction Coefficient | Wear Volume $10^2$ $mm^3$ |
|---|---|---|
| 6 PAO + 0.2 wt % MoDTC + 1.0 wt % di-isotridecyl adipate | 0.06 | 1.33 |
| 7 PAO + 0.2 wt % MoDTC + 10 wt % di-isodecyl azelate | 0.064 | 1.21 |
| 8 PAO + 0.2 wt % MoDTC + 10 wt % di-isotridecyl dodecandioate | 0.049 | 1.09 |

* = 100 ppm Mo from a MoDTC.

As the data illustrates, the combination of the molybdenum and a diester when added to the base oil composition synergistically improves both the friction coefficient and antiwear property of the lubricating oil composition. No such synergistically improved friction coefficient and antiwear property is obtained if the additive is 10 wt % of a high hydroxyl-containing ester of trimethylol propane and 0.2 wt % MoDTC.

With the foregoing description of the invention, those skilled in the art will appreciate that modifications may be made to the invention without departing from the spirit thereof. Therefore, it is not intended that the scope of the invention be limited to the specific embodiments illustrated and described.

What is claimed is:

1. A lubricating composition comprising: a major amount of an oil of lubricating viscosity, from about 0.005 to about 0.2 wt. % of a trinuclear molybdenum compound of the formula:

$$Mo_3S_kL_nQ_z$$

wherein each L is an independently selected ligand, each having an organo group with a sufficient number of carbon atoms to render the compound soluble or dispersible in the oil; n is from 1 to 4; k is from 4 to 7; Q is a neutral electron donating moiety; and z is from 0 to 5; and from about 3 to about 20 wt. % of a diester of an aliphatic or aromatic dicarboxylic acid, the wt. % being based on the weight of the lubricating composition.

2. A lubricating composition of claim 1 wherein molybdenum from the molybdenum compound is present in the lubricating composition in an amount of from about 0.01 to about 0.1 wt % and the diester in an amount of from about 5 to about 12 wt %.

3. A lubricating composition of claim 1, wherein the diester is a linear or branched dialkylester of an $C_6$ to $C_{13}$ aliphatic dicarboxylic acid wherein each of the alkyl groups of the diester contains from about 6 to about 13 carbon atoms.

4. A lubricating composition of claim 1 wherein the diester is a linear or branched dialkyl ester of an aromatic dicarboxylic acid wherein each of the alkyl groups of the diester contains from about 6 to about 13 carbon atoms.

5. A lubricating composition of claim 1 wherein the diester is selected from the group consisting of di-isotridecyl adipate, di-isodecyl adipate, di-isodecyl azelate and di-isotridecyl dodecandioate.

* * * * *